United States Patent [19]

Wiles

[11] 4,201,031

[45] May 6, 1980

[54] METHOD OF MAKING, OPENING, FILLING AND SEALING A TWO-COMPARTMENT POUCH

[75] Inventor: Jerald R. Wiles, Sarasota, Fla.

[73] Assignee: Rexham Corporation, New York, N.Y.

[21] Appl. No.: 946,111

[22] Filed: Sep. 27, 1978

[51] Int. Cl.[2] ..... B65B 43/04

[52] U.S. Cl. ..... 53/455; 53/459; 53/562

[58] Field of Search ..... 53/455, 459, 562

[56] References Cited

U.S. PATENT DOCUMENTS

| | | | |
|---|---|---|---|
| 2,913,861 | 11/1959 | MacNeale | 53/455 |
| 3,082,585 | 3/1963 | Waters | 53/455 X |

*Primary Examiner*—Travis S. McGehee

*Attorney, Agent, or Firm*—Leydig, Voit, Osann, Mayer & Holt, Ltd.

[57] ABSTRACT

An envelope-type pouch is divided into two compartments by a divider panel which is disposed between and is sealed to the two side panels of the pouch. The top margin of the divider panel and the top margin of one of the side panels are disposed above the top margin of the other side panel to facilitate opening of the pouch by an automatic packaging machine. Sealing of the upper end of the pouch is effected by first sealing the top margin of the divider panel to the top margin of the one side panel and then by sealing the top margin of the other side panel to the divider.

2 Claims, 4 Drawing Figures

METHOD OF MAKING, OPENING, FILLING AND SEALING A TWO-COMPARTMENT POUCH

BACKGROUND OF THE INVENTION

This invention relates to a pouch for food product or the like and to a method of making, opening, filling and sealing the pouch on an automatic packaging machine. The invention has more particular reference to a pouch whose interior is divided into two separate compartments so that the pouch preferably but not necessarily can hold two different products.

An automatic packaging machine of the same general type which can be used to practice the method of the present invention is disclosed in Johnson et al U.S. Pat. No. 3,700,388. In such a machine, a web, while being advanced along a predetermined path, is folded longitudinally to form two upright side panels connected by a bottom fold. The web is sealed at longitudinally spaced increments to form side seals and then is cut between the edges of each side seal to separate individual pouches from the web. Each pouch then is advanced along a predetermined path and, during the advance, the pouch moves beneath and along an elongated splitter blade which separates the top margins of the pouch so that the side panels may be spread apart and the pouch may be opened widely for filling. After product has been deposited into the pouch, the top margins of the side panels are sealed together to close the upper end of the pouch.

SUMMARY OF THE INVENTION

The general aim of the present invention is to provide a new and improved pouch whose interior is separated into two side-by-side compartments by a divider panel which extends from the bottom of the pouch to the top thereof, the divider panel and the side panels of the pouch being uniquely arranged to enable the two compartments to be opened automatically in proper sequence for filling by an automatic packaging machine.

A more detailed object is to provide a pouch in which the top margin of the divider panel and the top margin of one of the side panels are located above the top margin of the other side panel to enable the splitter blade of the packaging machine to separate the proper panels preparatory to filling of the first compartment of the pouch.

The invention also resides in the unique method by which the two-compartment pouch is made, opened and sealed.

These and other objects and advantages of the invention will become more apparent from the following detailed description when taken in conjunction with the accompanying drawings.

DETAILED DESCRIPTION OF THE PREFERRED EMBODIMENT

Figures 1, 2, 3, 4:
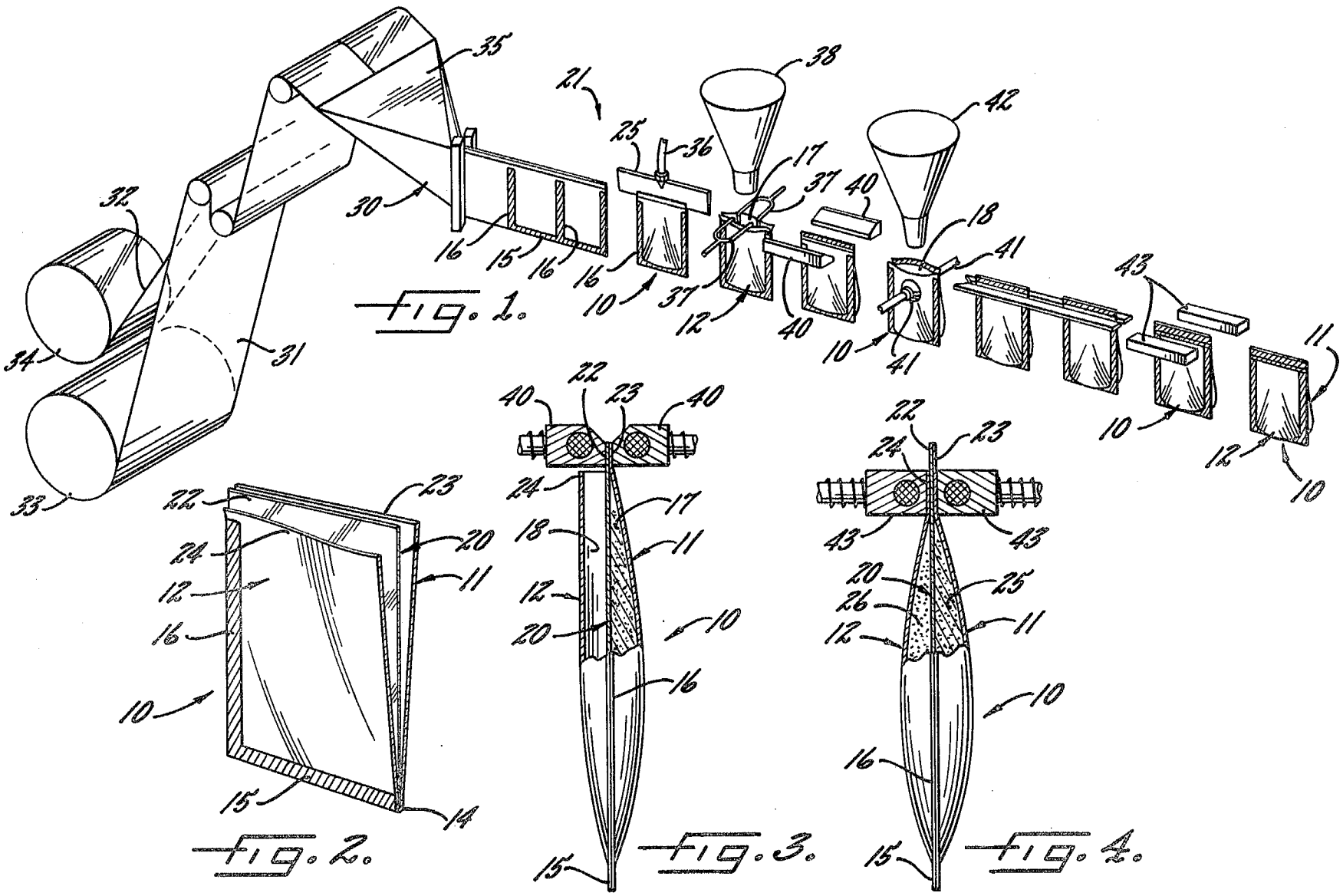
FIG. 1 is a schematic perspective view of an automatic packaging machine adapted to make, open, fill and close new and improved pouches incorporating the unique features of the present invention.
FIG. 2 is a perspective view of the pouch with some of the seals broken away to more clearly show the various panels of the pouch.
FIG. 3 is an elevational view of the pouch, with certain parts being broken away and illustrated in section, and showing the pouch during the sealing of one side panel to the divider panel.
FIG. 4 is a view similar to FIG. 3 but shows the pouch during the sealing of the other side panel to the divider panel.

For purposes of illustration, the present invention is shown in the drawings as incorporated in an envelope-type pouch 10 of the type which is commonly used to hold a food product. The pouch includes two opposing and generally upright side panels 11 and 12 made from a flexible piece of heat-sealable material or from flexible material with a heat-sealable coating. At their lower margins, the two panels are joined by a fold 14 (FIG. 2) and also are joined by a fin-type bottom heat seal 15 which strengthens the fold. Fin-type heat seals 16 extend along the two sides of the pouch and join the side margins of the side panels to one another.

The present invention contemplates the provision of a novel pouch 10 whose interior is separated into two compartments 17 and 18 (FIG. 3) by a divider panel 20 which is uniquely arranged relative to the side panels 11 and 12 to enable the two compartments to be opened and filled in proper sequence by an automatic packaging machine 21. For this purpose, the top margin 22 of the divider panel 20 and the top margin 23 of the side panel 11 are located above the top margin 24 of the side panel 12 (see FIG. 3). When the pouch is advanced along and beneath the conventional splitter blade 25 of the packaging machine, the staggered arrangement of the top margins of the panels enables the splitter blade to distinguish the panels from one another and to spread the proper panels preparatory to opening and filling of the first compartment 17.

More specifically and as shown most clearly in FIG. 3, the top margin 23 of the side panel 11 is located a short distance (e.g., ½ inch) above the top margin 24 of the side panel 12. The divider panel 20, which is made of flexible, heat-sealable material or material with a heat-sealable coating, is positioned between the two side panels 11 and 12 with its top margin 22 coextensive with the top margin 23 of the side panel 11 and located above the top margin 24 of the side panel 12. The side margins and bottom margin of the divider panel 20 are sandwiched between the side margins and bottom margins, respectively, of the side panels and are joined to the side panels by the side heat seals 16 and the bottom heat seal 15.

Thus, the panel 20 divides the pouch 10 into two separate compartments 17 and 18. The compartment 17 may contain one product 25 (FIG. 4) such as cookie mix while the compartment 18 may contain a separate product 26 such as chocolate chips. Both compartments could, however, contain the same product.

A full understanding of the significance of the location of the top margins 23 and 22 of the side panel 11 and the divider panel 20 relative to the top margin 24 of the side panel 12 will be facilitated by a more complete explanation of the operation of the packaging machine 21. The constructional details of a machine of this general type are disclosed in the aforementioned Johnson et al patent and thus a detailed description here is not necessary.

In brief, the pouch 10 is made from a web 30 consisting of a lower layer 31 of material which forms the side panels 11 and 12 and of an upper layer 32 of material which forms the divider panel 20. The lower layer 31 is initially stored on a lower supply roll 33 while the upper layer 32 is initially stored on an upper supply roll 34. The rolls are positioned such that the rear longitudinal edge of the upper layer 32 is alined with the rear longitudinal edge of the lower layer 31. The width of the upper layer 32 is just slightly more than one-half the width of the lower layer 31.

To form the pouch 10, the web 30 is pulled from the supply rolls 33 and 34 and is advanced step-by-step along a predetermined path by intermittently rotatable feed rolls (not shown). During the advance, the web is pulled beneath a plow 35 which folds the web upwardly in such a manner that the side panels 11 and 12 are formed by the lower layer 31 while the divider panel 20 is formed by the upper layer 32. The web 30 is not folded upwardly about the longitudinal centerline of the lower layer 31 but instead is folded about a longitudinal line which is offset forwardly from such centerline. As a result, the side panel 11 is of greater height than the side panel 12 and its top margin 23 is located above the top margin 24 of the side panel 12. Because of the positioning and width of the upper layer 32, the top margin 22 of the divider panel 20 is coextensive with the top margin 23 of the side panel 11 while the bottom margin of the divider panel extends into the fold 14 at the lower margins of the side panels.

When the folded web 30 dwells between successive steps, a pair of coacting seal bars (not shown) forms vertically extending seals at longitudinally spaced increments along the web, such seals defining the side seals 16 of the pouches. An additional pair of coacting seal bars (not shown) seals the bottom of the web to form the bottom seal 15 of the pouches.

After the seals 15 and 16 have been formed, a knife (not shown) cuts through each side seal 16 between the edges thereof in order to separate the leading pouch 10 from the web 30. That pouch then is picked up by an intermittently movable chain (not shown) and is advanced step-by-step through the pouch filling and closing section of the machine 21.

As each pouch 10 advances, its upper end passes beneath and along the splitter blade 25. During such advance, the top margins 23 and 22 of the side panel 11 and the divider panel 20 thread onto and straddle the splitter blade 25 and thus the blade separates the top margins of those panels from their initially flat face-to-face relationship to partially open the compartment 17. A jet of air may be introduced through the splitter blade and into the compartment 17 by means of a hose 36 leading to the splitter blade in order to help separate the side panel 11 from the divider panel 20. Because the top margin 24 of the side panel 12 is located below the top margins 23 and 22 of the panels 11 and 20, the top margin 24 does not reach the splitter blade 25 and thus there is no danger of the pouch moving along the blade with the top margins 24 and 22 of the side panel 12 and the divider panel 20 straddling the blade. Thus, the blade is effective to separate the side panel 11 and the divider panel 20 and to open the compartment 17 but is ineffective to separate the side panel 12 and the divider panel 20 and open the compartment 18.

Immediately after the pouch 10 leaves the splitter blade 25, two openers 37 duck into the pouch. Because the compartment 17 has been partially opened by the splitter blade, the openers enter that compartment rather than the compartment 18. The openers then are moved laterally and pull the side panel 11 away from the divider panel 20 and the side panel 12 to open the compartment 17 widely preparatory to filling. Accordingly, the product 25 may be introduced into the compartment 17 by means of a dispenser 38.

The pouch 10 then is advanced from beneath the dispenser 38 and between a pair of coacting seal bars 40 (FIGS. 1 and 3) which, when the pouch dwells, seal the top margin 23 of the side panel 11 to the top margin 22 of the divider panel 20 to close the compartment 17 (see FIG. 3). The seal bars 40 are located at such an elevation that they do not engage the top margin 24 of the side panel 12 and thus the compartment 18 remains open.

When the pouch 10 next dwells, two suction cups 41 engage and pull laterally on the side panels 11 and 12 to open the compartment 18. Because the top margin 22 of the divider panel 20 is sealed to the top margin 23 of the side panel 11, the suction cups serve to pull both the side panel 11 and the divider panel 20 away from the side panel 12 and thus the compartment 18 is opened widely. The product 26 then may be introduced into that compartment by a dispenser 42.

The pouch 10 then is advanced to and dwells between another pair of seal bars 43 (FIGS. 1 and 4). When these seal bars are actuated, they seal the top margin 24 of the side panel 12 to the divider panel 20 to close the compartment 18 (see FIG. 4). The top seal thus comprises an upper portion formed by the seal bars 40 and further comprises a lower portion formed by the seal bars 43. If desired, the seal bars 43 may be of such height as to also act against the top margin 23 of the side panel 11 and thus improve the integrity of the top seal between that panel and the divider panel 20. In such a case, the initial seal (i.e., that formed by the seal bars 40) between the top margin 23 of the side panel 11 and the top margin 22 of the divider panel 20 need only be a tack seal.

From the foregoing, it will be apparent that the present invention brings to the art a new and improved pouch 10 which is separated into two compartments 17 and 18 by the divider panel 20 and which is adapted to be made and handled on the automatic packaging machine 21. In the present instance, the bottom margin of the divider panel 20 is sealed to the bottom margin of both side panels 11 and 12 while the side margins of the divider panel are sealed to the side margins of both side panels. Those of ordinary skill in the art will appreciate, however, that the bottom and side margins of the divider panel could be sealed to the bottom and side margins of only one side panel and that that side panel could be sealed directly to the other side panel. Also, the divider panel 20 could be used in conjunction with a gusset bottom pouch. In such an instance, the lower margin of the divider panel may be sandwiched between the two layers which form one wing of the gusset bottom and may be sealed to one or both of such layers.

I claim:

1. A method of opening, filling and sealing an upright pouch having first and second opposing side panels, having a divider panel located between the side panels, and having an upper end which is initially unsealed, said divider panel being sealed to the side margins and the bottom margin of at least one of said side panels and dividing the interior of the pouch into two compartments, the first side panel and the divider panel having top margins which are located above the top margin of the second side panel, said method comprising the steps of, advancing the pouch along a predetermined path, separating the upper margin of the divider panel from the upper margin of said first side panel as the pouch is advanced, pulling the divider panel and said second side panel away from said first side panel to open one compartment of the pouch, depositing product into said one compartment, sealing the divider panel to the top margin of said first side panel to close the upper end of said one compartment, pulling the divider panel and said first side panel away from said second side panel to open the other compartment of the pouch, depositing product into said other compartment, and sealing the top margin of said second side panel to said divider panel to close the upper end of said other compartment.

2. A method of making, opening, filling and sealing a pouch having two opposing side panels and having a divider panel located between the side panels and dividing the interior of the pouch into two compartments, said method comprising the steps of, advancing a web along a predetermined path, said web having a lower layer of predetermined width and having an upper layer with a width which is less than said predetermined width, said upper layer being positioned with one of its longitudinal margins adjacent one of the longitudinal margins of the lower layer, folding the web upwardly during its advance about a longitudinal line which is spaced farther from said one margin of said lower layer than from the other margin of said lower layer thereby to form two side panels and a divider panel with the top margin of a first one of said side panels and the top margin of the divider panel being located above the top margin of the second one of said side panels, sealing the side panels and the divider panel together at longitudinally spaced increments and along their bottoms to form side seals and a bottom seal, cutting through the panels between the edges of each side seal thereby to separate individual pouches from the web, advancing the separated pouches along a predetermined path, separating the upper margin of the divider panel of each pouch from the upper margin of the first side panel of the pouch as the pouch is advanced, pulling the divider panel and the second side panel of each pouch away from the first side panel of the pouch to open one compartment of the pouch, depositing product into said one compartment, sealing the divider panel to the top margin of said first side panel to close the upper end of said one compartment, pulling the divider panel and the first side panel of each pouch away from the second side panel thereof to open the other compartment of the pouch, depositing product into said other compartment, and sealing the top margin of said second side panel to said divider panel to close the upper end of said other compartment.

* * * * *